US009552972B2

(12) United States Patent
Cramer

(10) Patent No.: US 9,552,972 B2
(45) Date of Patent: Jan. 24, 2017

(54) METHOD FOR ION PRODUCTION

(71) Applicant: MICROMASS UK LIMITED, Wilmslow (GB)

(72) Inventor: Rainer Karl Cramer, Reading (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/654,197

(22) PCT Filed: Dec. 20, 2013

(86) PCT No.: PCT/GB2013/053381
§ 371 (c)(1),
(2) Date: Jun. 19, 2015

(87) PCT Pub. No.: WO2014/096847
PCT Pub. Date: Jun. 26, 2014

(65) Prior Publication Data

US 2015/0325422 A1 Nov. 12, 2015

(30) Foreign Application Priority Data

Dec. 21, 2012 (GB) ..... 1223131.2

(51) Int. Cl.

| | |
|---|---|
| ***H01J 49/10*** | (2006.01) |
| ***H01J 49/04*** | (2006.01) |
| ***H01J 49/00*** | (2006.01) |
| ***H01J 49/42*** | (2006.01) |
| ***H01J 49/16*** | (2006.01) |

(52) U.S. Cl.
CPC ..... *H01J 49/0468* (2013.01); *H01J 49/0031* (2013.01); *H01J 49/164* (2013.01); *H01J 49/4215* (2013.01)

(58) Field of Classification Search
USPC ..... 250/281, 282, 283, 288, 423 R, 423 P
See application file for complete search history.

(56) References Cited

U.S. PATENT DOCUMENTS

2012/0085903 A1* 4/2012 Trimpin ..... H01J 49/044 250/282
2013/0214154 A1 8/2013 McEwan et al.

OTHER PUBLICATIONS

König et al., "*Generation of Highly Charged Peptide and Protein Ions by Atmospheric Pressure Matrix-Assisted Infrared Laser Desorption/Ionization Ion Trap Mass Spectrometry*", Analytical Chemistry, vol. 79, No. 14, pp. 5484-5488, 2007.

* cited by examiner

*Primary Examiner* — Nicole Ippolito
(74) *Attorney, Agent, or Firm* — Diederiks & Whitelaw, PLC

(57) ABSTRACT

A method for producing multiply charged ions is provided. In the method, a laser is used to ablate a sample comprising a matrix and an analyte. The sample is in the liquid form when it is ablated and the ions produced are passed through a heated conduit. The multiply charged ions produced may be used in mass spectrometry to measure the mass of the analyte.

16 Claims, 10 Drawing Sheets

METHOD FOR ION PRODUCTION

CROSS-REFERENCE TO RELATED APPLICATIONS

This application is the National Stage of International Application No. PCT/GB2013/053381, filed 20 Dec. 2013 which claims priority from and the benefit of United Kingdom patent application No. 1223131.2 filed on 21 Dec. 2012. The entire contents of these applications are incorporated herein by reference.

BACKGROUND OF THE PRESENT INVENTION

The invention relates to methods of producing ions. The ions produced may be used in the field of mass spectrometry.

In biological mass spectrometry (MS), two ionization techniques are predominantly employed for the analysis of analytes which are larger biomolecules, for example polypeptides. These are nanoelectrospray ionization (nanoESI) and matrix-assisted laser desorption/ionization (MALDI). In MALDI a laser is used to ablate a matrix/analyte material to release ions into the gas phase. These ions are then passed into a mass analyzer/spectrometer. Both techniques are considered to be 'soft', allowing the desorption and ionization of intact molecular analyte species and thus their successful mass spectrometric analysis. One of the main differences between these two ionization techniques lies in their ability to produce multiply charged ions. MALDI typically generates singly charged ions when used with peptide analytes while nanoESI easily provides multiply charged ions, even for peptides as low as 1,000 Da in mass. The production of highly charged ions is desirable as this allows the use of mass analyzers such as ion traps (including orbitraps) and hybrid quadrupole instruments, which typically offer only a limited m/z range (<2,000-4,000). It also enables more informative fragmentation spectra using techniques such as collision-induced dissociation (CID) and electron capture/transfer dissociation (ECD/ETD) in combination with tandem MS (MS/MS). The MALDI technique can be preferable as it has higher tolerance to contaminants and additives, ease-of-operation, potential for high-speed and automated sample preparation and analysis as well as MS imaging capabilities. Thus, MALDI is an ionization technique that can cover bioanalytical areas where ESI is less suitable. A MALDI technique which can produce multiply charged ions is therefore desirable.

Previous MALDI methods which have applied a laser to a liquid matrix/analyte system are described in 'Liquid ultraviolet matrix-assisted laser desorption/ionization-mass spectrometery for automated proteomic analysis, R. Cramer and S. Corless Proteomics 2005, 5, 360-370' and 'Employing target modifications for the investigation of liquid infrared matrix-assisted laser desorption/ionization mass spectrometery, R. Cramer and A. L. Burlingame, Rapid Commun. Mass Spectrom. 14, 53-60 (2000)'. Neither of these methods produced desirable amounts of multiply charged ions.

SUMMARY OF INVENTION

In a first aspect, the present invention provides a method for producing multiply charged ions comprising the steps of;

i) providing a matrix composition comprising a matrix material and a non-volatile component, ii) providing an analyte, iii) depositing the composition and the analyte on a surface such that they are in intimate contact, iv) ablating the composition and the analyte deposited on the surface with a laser to desorb multiply charged ions of analyte, and v) passing the desorbed multiply charged ions through a heated conduit, wherein, in step iv), the matrix composition and analyte are ablated in the liquid phase.

The matrix material comprises molecules which are able to transfer or receive charges from the analyte. Preferably the matrix material comprises molecules which possess a chromophore which absorbs strongly in the UV or IR regions of the spectrum. Many matrix materials are known in the art, for example those stated at paragraphs [0133] to of WO2012/058248 A2, and in particular those stated at paragraph [0137] of that document, all of which may be used in the present method and which are incorporated herein by reference.

The non-volatile component is a liquid under the ambient conditions at the surface on which it is deposited (that is, when the laser is not being applied to the composition and analyte). The vapour pressure of the non volatile component is low enough at these conditions for it not to evaporate over the duration of several laser shots, for example over at least 1 minute. The method may be carried out at about atmospheric pressure. In a preferred embodiment, the surface on which the matrix composition and analyte are deposited is a sample plate of a mass spectrometer. In this embodiment, the conditions under which the non-volatile component must remain a liquid are those inside the ion source of a mass spectrometer. These could be; cooled below room temperature, room temperature, or up to the temperature of a heated ion conduit disposed adjacent to the sample plate (see FIG. 1). In some embodiments this temperature may be up to 400° C. The mass spectrometer may be operated at atmospheric pressure, medium vacuum, high vacuum or ultra high vacuum, for example $10^{-9}$ Torr. In embodiments where these pressures are present, the non-volatile component must still remain a liquid. One may select an appropriate non-volatile component according to the anticipated temperature and pressure in the vicinity of the deposition surface.

The fact that the non-volatile component remains in the liquid form on the surface means that the laser is applied to a liquid matrix and analyte composition rather than a solid matrix and analyte composition. This distinguishes the method from most typical MALDI methods which subject a solid matrix and analyte composition to laser ablation. The analyte is the moiety which is to be ionized such that it is multiply charged. Many types of molecule may be charged in the present method. The method is however most useful for providing multiply charged ions of large biomolecules, for example polypeptides. The surface and heated conduit may form part of a mass spectrometer/analyzer.

Surprisingly, the passing of the ions (released from the matrix composition and analyte on ablation) through the heated conduit results in an increased number of multiply charged analyte ions exiting an apparatus than if the heated conduit were not present. Thus, a greater number of multiply charged ions are available for analysis. The mechanism of the action of the heated conduit on the multiply charged ions travelling therethrough has not yet been established.

The present method provides good reproducibility and prolonged ion yield over many laser shots. Only a low laser fluence is required in the present method. This has the advantages of low power use and low rate of ablation. The low rate of ablation has advantages over high fluence processes such as Laserspray ionization (LSI), for example, the analyte consumption is minimized. This is clearly advantageous when dealing with biological substances having a very low availability. The fact that the analyte is prepared as a liquid and the subject of the ablation is also a liquid allows flexibility in adding other components (additives) for achieving a greater range of various sample conditions/environments.

The analyte concentration in the matrix composition and analyte deposited on the surface may be as low as $10^{-12}$ M.

The heated conduit may be maintained at a temperature of up to 400° C., and is preferably maintained at between 200° C. and 250° C. The heated conduit may be a tube. The matrix material of the matrix composition of step i) is preferably either 2,5-dihydroxybenzoic acid (DHB) or a cinnamic acid derivative such as a~cyano-4-hydroxycinnamic acid (CHCA). The matrix composition of step i) may further comprise a solvent. The solvent may be any liquid which is suitable for dissolving the analyte and the matrix material. The solvent may be a 1:1 mixture of 10-100 mM of ammonium phosphate (in water) and methanol. The solvent is preferably vapourized by the ambient conditions at the surface on which it is deposited (even when the laser is not being applied to the composition). Preferably the solvent vaporises in around 15-30 minutes. The solvent may comprise a 1:1 mixture of 20 mM ammonium phosphate (in water) and methanol.

The laser may be a pulsed laser having an energy of less than 10 μJ per pulse. The laser may achieve a maximum fluence of less than 2000 J/m$^2$, In a preferred embodiment, the laser is a pulsed laser, the energy per pulse is about 1-10 μJ and the fluence is between about 200-2000 J/m$^2$. The analyte may be a peptide, protein or other biomolecule or organic compound.

The non-volatile component may be glycerol, triethylamine or an ionic liquid. The glycerol concentration in the matrix composition of step i) may be between 15% and 85% by volume.

The multiply charged ions exiting the heated conduit may be passed into a mass analyzer which preferably comprises an ion trap or quadrupole. The analyte concentration in the matrix composition and analyte deposited on the surface may be as low as $10^{-12}$ M, the laser may be a pulsed laser having a repetition rate of 10 Hz, and data may be acquired in the mass analyzer for at least 10 minutes, or more. The laser may have a UV or IR wavelength.

BRIEF DESCRIPTION OF THE DRAWINGS

A detailed description of the invention follows by way of example only. Reference is made to the drawings in which:

FIG. 4).

DETAILED DESCRIPTION OF THE PREFERRED EMBODIMENTS

The liquid matrix compositions described in this disclosure are based on either 2,5-dihydroxybenzoic acid (DHB) or α-cyano-4-hydroxycinnamic acid (CHCA) with the addition of glycerol and optionally triethylamine in various concentrations.

The first step in the preparation of the MALDI matrix compositions is the addition of 20-100 mM ammonium phosphate/methanol (1:1; v:v) to the solid UV matrix compound DHB or CHCA in a ratio of 10:1 (v[μL]:w[mg]). For DHB-based liquid matrices, glycerol is then added and the resultant mixture is thoroughly vortexed and then sonicated for 5-10 min. For the CHCA-based liquid matrix 1-1-10, triethylamine is added at a tenth of the volume of the ammonium phosphate/methanol solvent and vortexed with subsequent addition of various volumes of glycerol, while the CHCA-based 1-3-5-10 matrix is prepared by specifically adding triethylamine using 30% of the volume of the ammonium phosphate/methanol solvent and another addition of glycerol at 50% volume. After each addition, the mixture is thoroughly vortexed and then sonicated for 5-10 min. Peptides and proteins are dissolved in water at concentrations of $10^{-7}$ to $10^{-3}$ M. MALDI samples are deposited directly on the stainless steel target plate by spotting 0.5-1 μL of the analyte solution first and subsequently 0.5-1 μL of the matrix solution. The samples are left at ambient conditions for 15-30 min to allow evaporation of the volatile solvent components. Mass spectra were acquired on a modified Q-Star Pulsar i instrument (AB Sciex, Toronto, Canada) with a custom-made AP-MALDI source based on a design previously reported and shown in FIG. 1. Unless stated otherwise, mass spectra were recorded at a transfer tube temperature of 225° C. by accumulating ~60 scans with a scan time of 1 sec.

Figure 1:
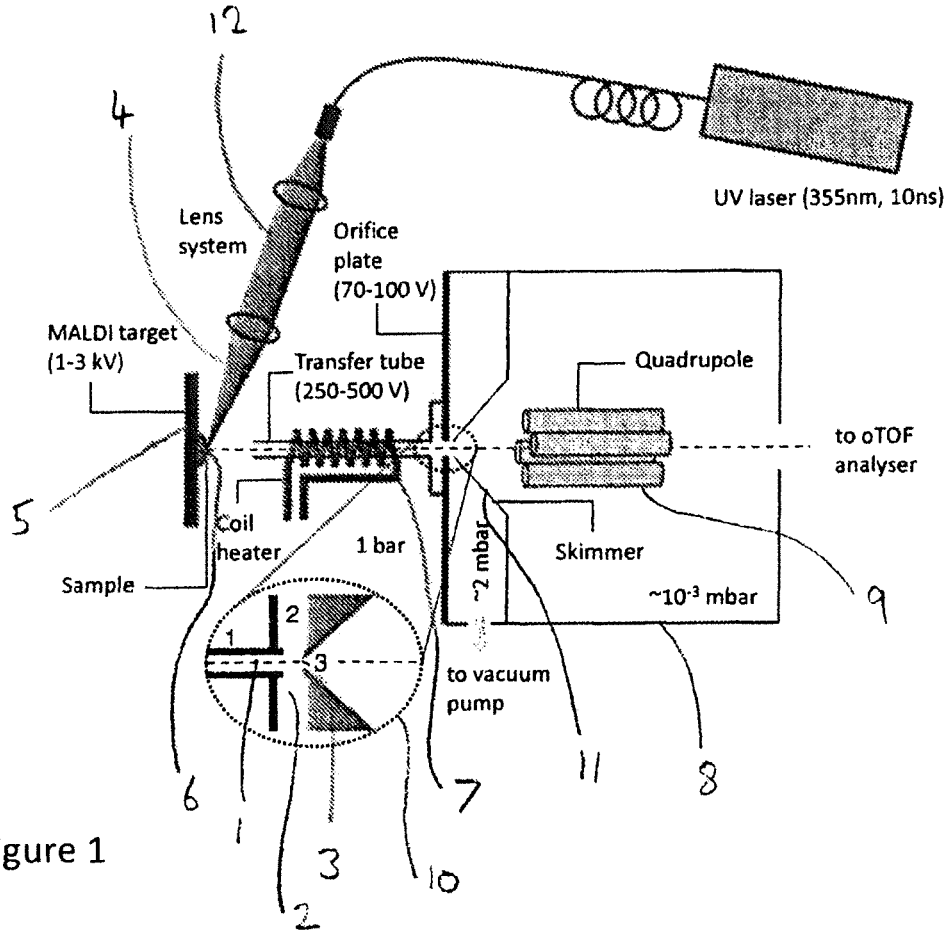
FIG. 1 is a schematic view of an apparatus for carrying out the method of the present invention.

FIG. 1 shows the ion source design generally used for all atmospheric pressure UV-MALDI MS measurements. The laser apparatus (12) emits a 355 nm wavelength light pulse (4) of 10 ns duration. The pulse of light is directed upon the target plate (5). More specifically, the light is directed upon the matrix composition and analyte (6) disposed in the centre of the plate. The laser ablates the composition and analyte and produces a plume of multiply charged ions. The plate is held at a voltage of around 1.5-3 kV. The heated transfer tube is at a potential of around 250-500 V. The potential difference draws the ion plume into the heated transfer tube (1). The transfer tube is heated by a coil heater (7) wrapped around the outside of the tube. The ions pass through the tube and through the discriminator interface. The inset shows a diagram of the particle discriminator interface (10). The heated transfer tube (1) has a diameter of 2 mm and a length of 40 mm. It is separated from the standard ESI orifice plate (3) (with its flow limiting orifice (having a diameter of 250 μm)) by a ceramic spacer (2), producing a gap between the ion transfer tube and the orifice of 1-mm thickness and 4-mm diameter. Sealing is improved by an O-ring surrounding the ceramic spacer. The interior of the mass spectrometer/analyzer (8) is held at a pressure of around $10^{-3}$ bar. This is lower than the pressure of its surroundings. Once the ions have passed through the discriminator interface (10) and a skimmer (11), their mass is analyzed by a quadrupole (9) and a time of flight tube (not shown).

The laser and ion source used, together with a measured maximum laser energy of around 10 μJ on target allows an achievable maximum fluence of <2000 J/m$^2$. Compared to laserspray ionization (LSI), a recently introduced approach for laser-induced generation of multiply charged ions, this value is more than one order of magnitude below the reported LSI fluence range of 40-150 kJ/m$^2$. A major disadvantage of these LSI irradiation conditions is the typically rapid depletion of the sample. However, using the present method, multiply charged ions may be obtained with laser energies as low as ~1 μJ, resulting in a fluence of <200 J/m$^2$, which is within the range of typical UV-MALDI MS fluences and more than two orders of magnitude below the reported LSI fluence range. Thus, continuous analyte ion signal detection from tens of thousands of consecutive laser shots may be achieved with concomitant low sample consumption.

Analytes in the mid-femtomole range are sufficient to produce predominantly multiply rather than singly charged ions with a stable analyte ion beam for up to 36000 laser shots, i.e. for a 1 hour data acquisition. Ion charge states varied depending on the exact nature of the liquid MALDI matrix composition, and alkali cationization decreased with charge state while sizable matrix adduct ion formation was only observed for singly charged ions.

Figure 2A:
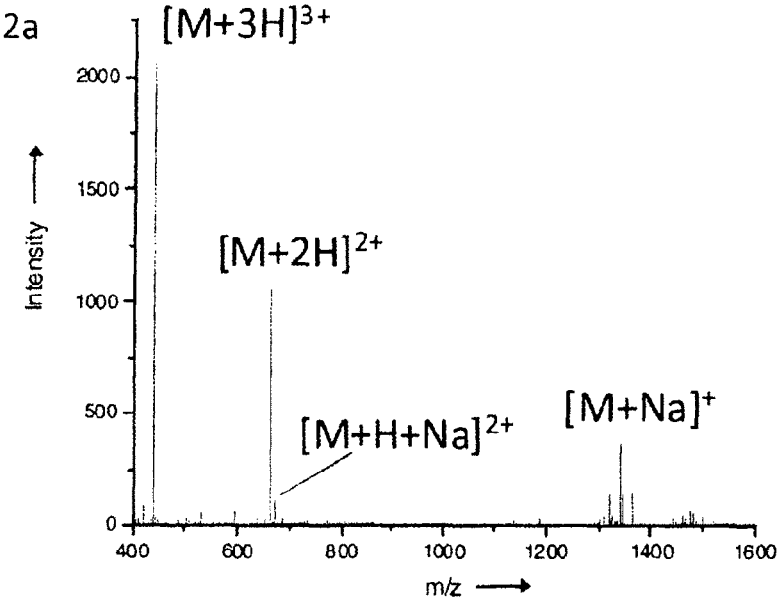
FIG. 2*a*) and FIG. 2*b*) show an atmospheric pressure UV-MALDI mass spectrum of MK-bradykinin (sequence: MKRPPGFSPFR), displaying in FIG. 2*a*) the m/z range 400-1600 and in FIG. 2*b*) the m/z range 1200-1600. The matrix is a DHB-based liquid matrix composition containing ~20% glycerol before volatile solvent evaporation.
Figure 2B:
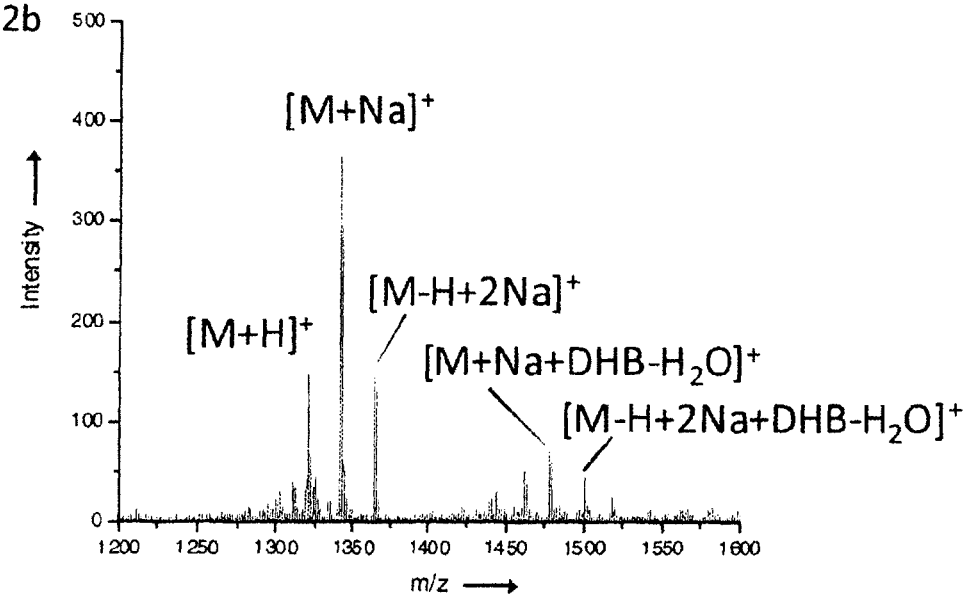

FIG. 2*a*) and FIG. 2*b*) show a liquid atmospheric pressure UV-MALDI mass spectrum of MK-bradykinin (sequence: MKRPPGFSPFR) revealing singly, doubly and triply charged analyte ions. In general, adduct ion formation is far less for the multiply charged ions than for singly charged ions. As seen in FIG. 2*a*) and FIG. 2*b*), there are no significant adduct ions detected for the triply charged MK-bradykinin ion, while significant amounts of analyte/cation clusters with alkali metals and the matrix chromophore compounds are detected for the singly charged ion species. The absence of adduct ions for multiply charged ions is an important observation since liquid MALDI samples are typically a good source of salt cations and thus generally support cation adduct formation.

Figure 3A:
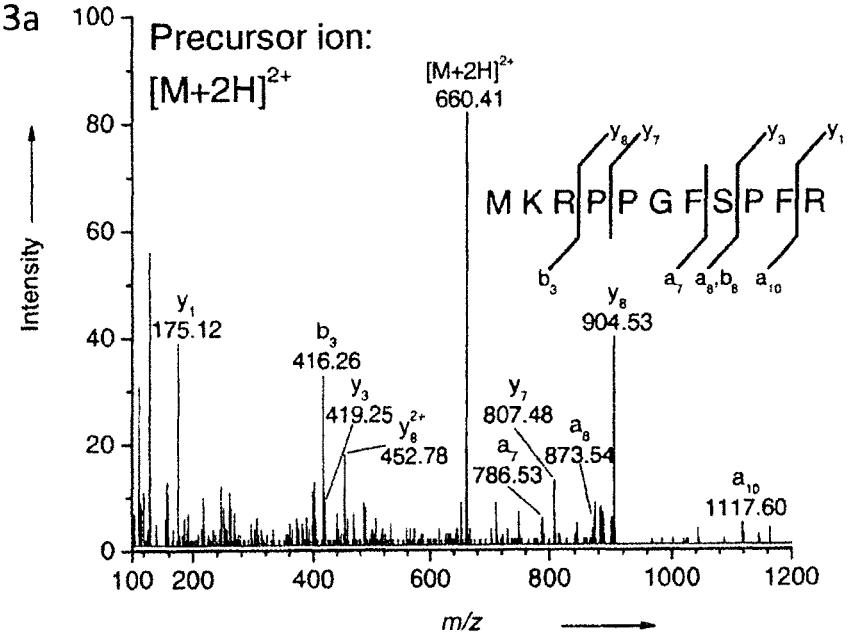
FIG. 3*a*) and FIG. 3*b*) show atmospheric pressure UV-MALDI CID MS/MS spectra of the a) doubly and b) triply protonated MK-bradykinin ions. The matrix composition is a DHB-based liquid matrix containing ~20% glycerol before volatile solvent evaporation. The collision potentials were 35V and 20V, respectively.
Figure 3B:
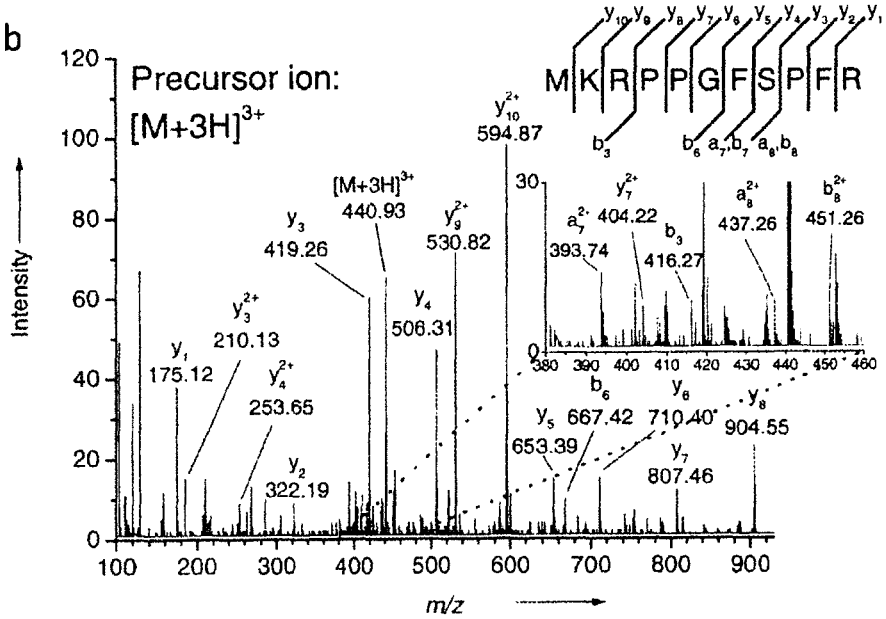

The generation of multiply charged peptide ions greatly facilitates their fragmentation and thus sequencing. FIG. 3*a*) and FIG. 3*b*) display the Collision induced dissociation (CID) MS/MS fragment spectra of MK-bradykinin for the doubly and triply charged ion species. In general, these fragmentation spectra, displaying mainly b- and y-type ion series and other associated fragment ions as well as iminium ions, are similar to CID MS/MS spectra of doubly and triply charged peptide ions generated by other soft ionization techniques.

Figure 6:
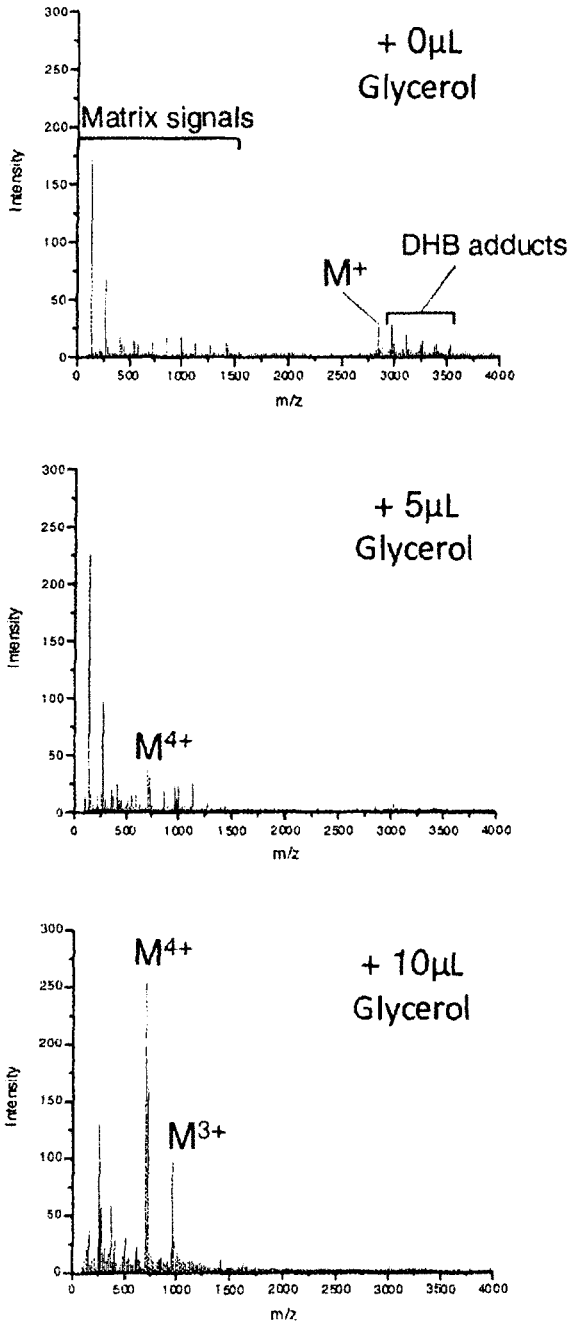
FIG. 6 shows atmospheric pressure UV-MALDI mass spectra of melittin. The matrix composition was a DHB-based (liquid) matrix with the addition of 0, 5, and 10 μL of glycerol to 50 μL of matrix stock solution. The MALDI samples were prepared directly on the MALDI plate by spotting 0.5 μL of the analyte solution first and subsequently 0.5 μL of the matrix solution. For the sample preparation without any glycerol extensive DHB clusters were detected.
Figure 7:
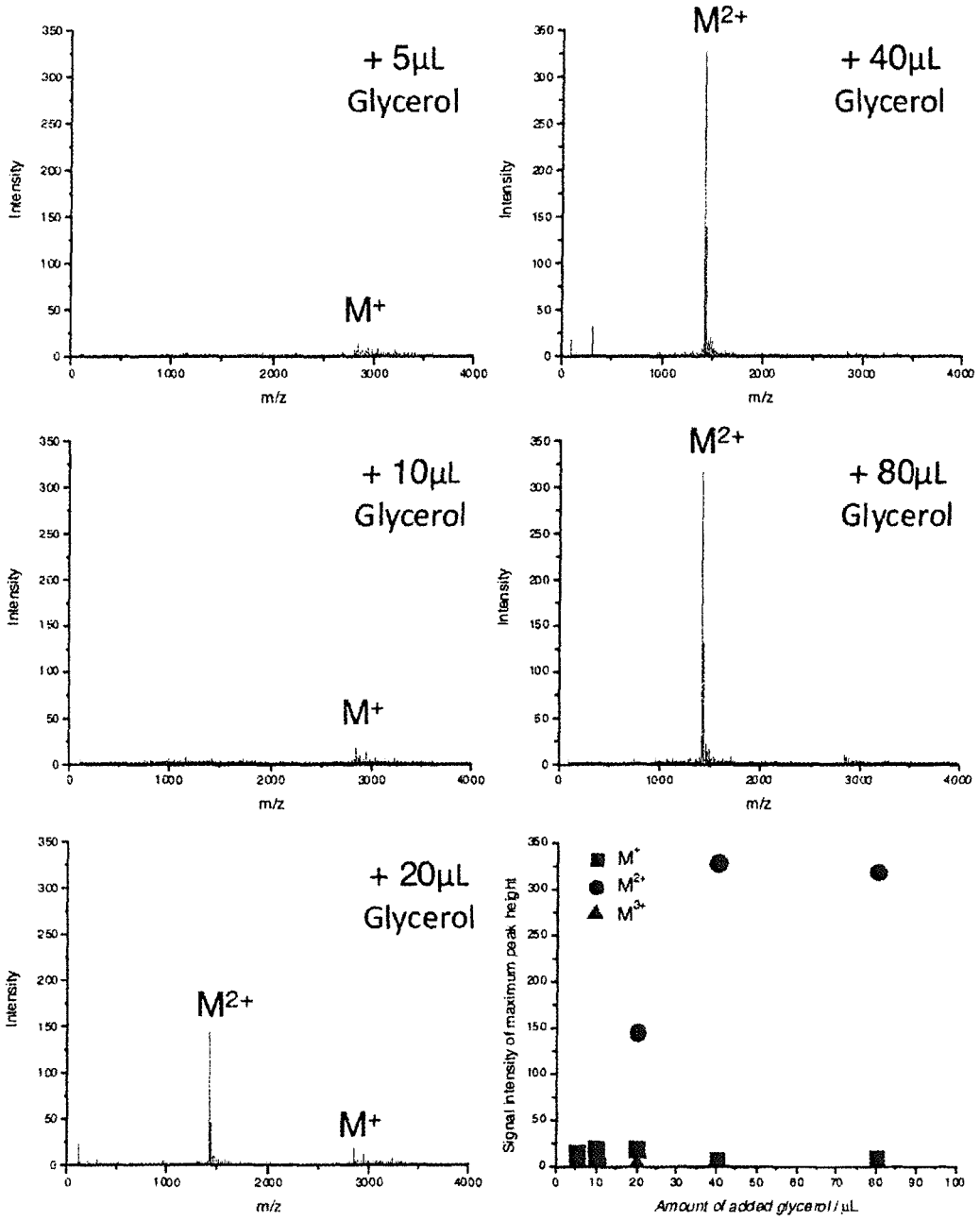
FIG. 7 shows atmospheric pressure UV-MALDI mass spectra of melittin. The matrix composition was the CHCA-based 1-1-10 liquid matrix with the addition of 5, 10, 20, 40 and 80 μL of glycerol to 100 μL of matrix stock solution. The MALDI samples were prepared directly on the MALDI plate by spotting 0.5 μL of the analyte solution first and subsequently 0.5 μL of the matrix solution. The bottom right panel displays the signal intensities of the maximum peak height extracted from all five spectra for $M^+$, $M^{2+}$, and $M^{3+}$.
Figure 10:
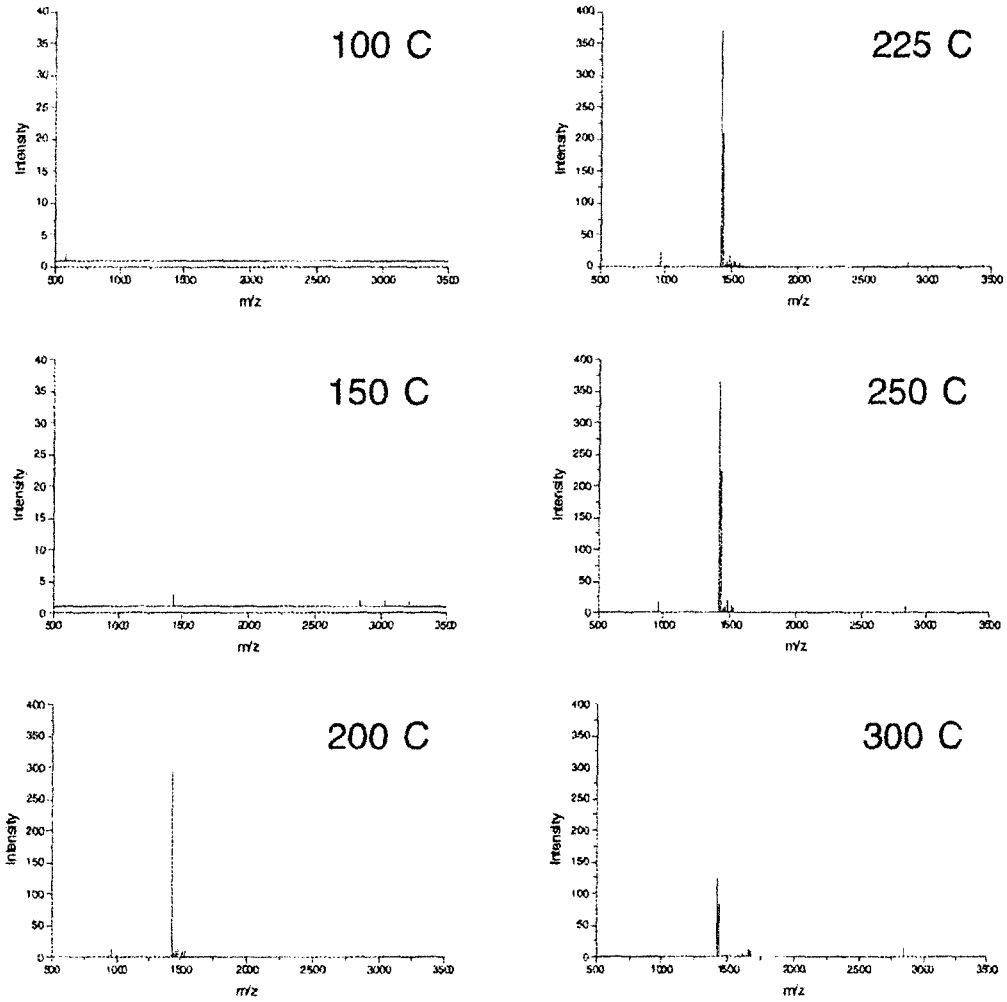
FIG. 10 shows atmospheric pressure UV-MALDI mass spectra of melittin acquired at various transfer tube temperatures. The matrix composition was the CHCA-based 1-3-5-10 liquid matrix.

Although the formation of multiply charged ions is highly favoured, it is possible to detect significant amounts of singly charged ions for lower mass analytes, similar to other ionization techniques such as ESI. However, it should be emphasized that in all of the present examples using liquid matrix compositions in conjunction with the heated transfer tube it is easier to detect the analyte as a multiply, rather than singly, charged ion species. This is also evident in the results from two optimization experiments. The first demonstrates the optimum transfer tube temperature for providing the highest yields of multiply charged analyte ions. The results are shown in FIG. 10. Apart from finding an optimum temperature of 200-250° C. for the 1-3-5-10 liquid matrix, the data also suggests that the formation of singly charged ions is far less affected by the temperature than the formation of multiply charged species. This can also be seen in the second experiment, which demonstrates the optimum amount of glycerol in the liquid matrix. The results are shown in FIGS. 6 and 7. Here, the signal of the singly charged ion species actually decreases when yields of the multiply charged increase. For all liquid matrix compositions investigated, the liquidity of the sample (provided by the glycerol) was an essential component for the formation of multiply charged ions. Typically, a sufficient amount of glycerol that guarantees a fully liquid MALDI sample appears to work the best.

Changing the composition of the liquid matrix composition appears to have an effect on the detectable charge states and their distribution. For melittin, the 1-1-10 matrix composition enables just the detection of the doubly charged ion species while switching to the DHB-based liquid matrix composition facilitates the detection of the triply and quadruply charged ions with a negligible signal for the doubly charged species. This is shown in FIGS. 6 and 7. The potential of the DHB-based liquid matrix composition to generate higher charge states is also observed for MK-bradykinin.

Figure 4A:
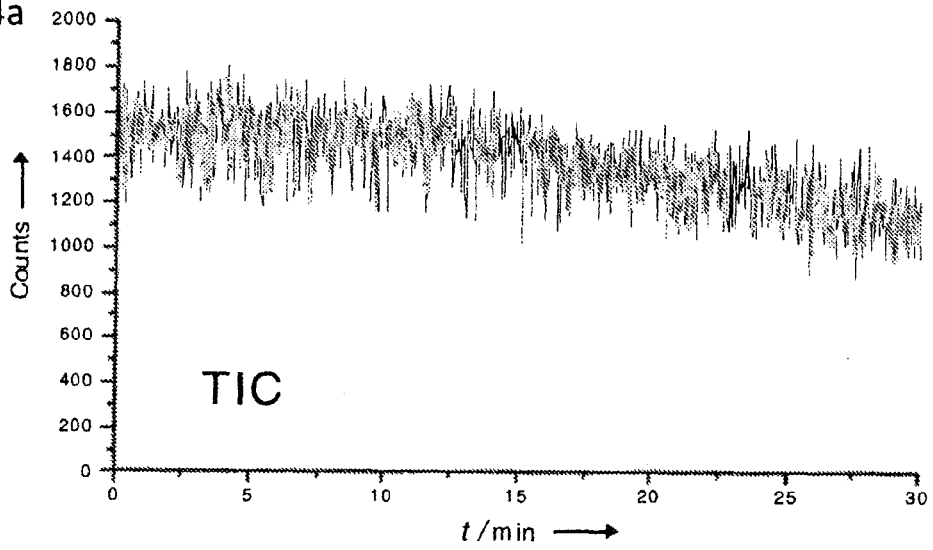
FIG. 4*a*) is a total ion chromatogram (TIC) over a 30-min data acquisition using a liquid MALDI sample containing 500 fmol of melittin.
Figure 4B:
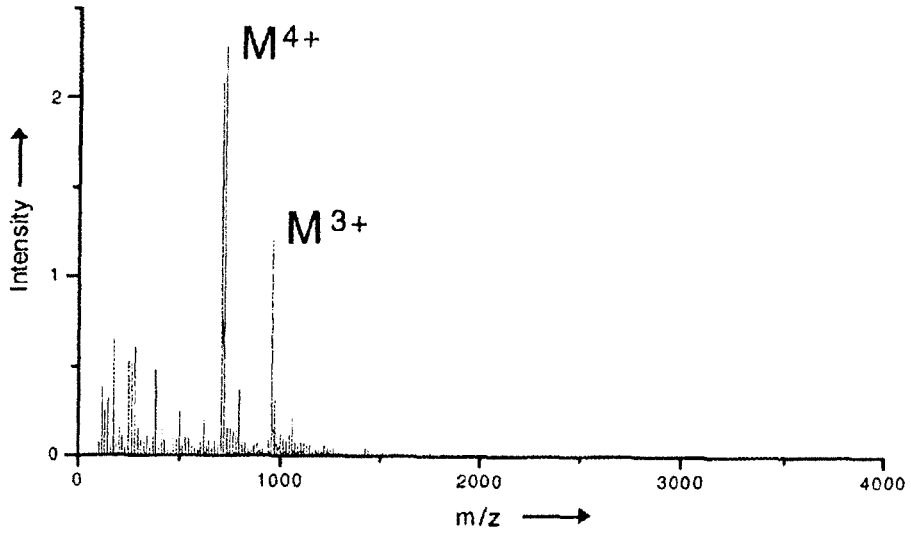
FIG. 4*b*) is an atmospheric pressure UV-MALDI mass spectrum of the sum of all scans of the acquisition of FIG. 4*a*. The matrix composition was a DHB-based liquid matrix containing ~20% glycerol before volatile solvent evaporation, and the laser repetition rate was 10 Hz.
Figure 8A:
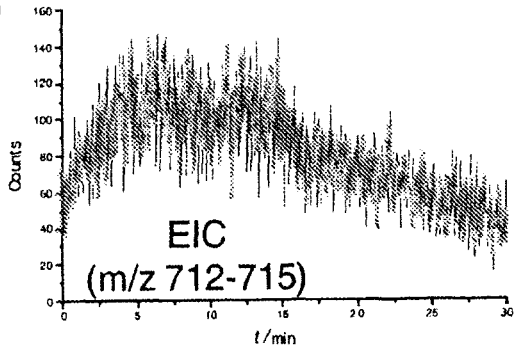
FIG. 8*a*) is an extracted ion chromatogram (EIC) with an m/z window of 712-715 over a 30-min acquisition of a liquid MALDI sample containing 500 fmol melittin (cf.
Figure 8B:
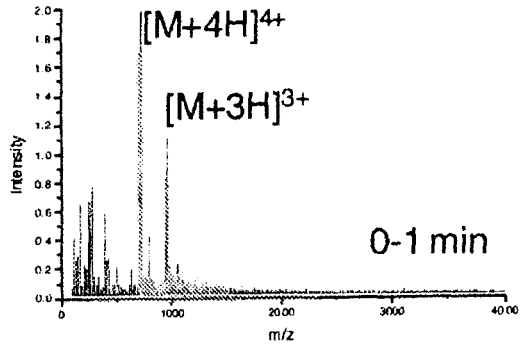
FIGS. 8*b*) and 8*c*) are atmospheric pressure UV-MALDI mass spectra combining the scans of the b) first minute and c) last minute of the acquisition shown in FIG. 8*a*). The matrix composition was the DHB-based liquid matrix containing ~20% glycerol before volatile solvent evaporation. The laser repetition rate was 10 Hz, and the transfer tube temperature was 225° C.
Figure 8C:
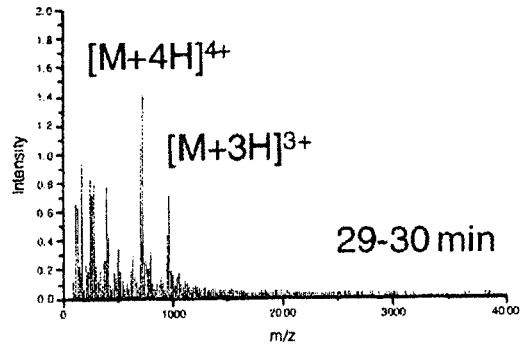

One of the advantages of liquid MALDI samples is the relatively stable ion flux and spot (matrix composition and analyte) durability during laser ablation due to the self-healing properties of the liquid. FIG. 4 shows the liquid MALDI MS spectrum and total ion chromatogram (TIC) of 1,800 scans (half-hour acquisition) of a melittin sample. The extracted ion chromatogram (EIC) for the $[M+4H]^{4+}$ melittin ion shows a similarly stable ion yield, and spectra generated from combining only the scans from the first minute are virtually identical to the combination of the scans in the last minute, see FIG. 8. In this case, 500 fmol of melittin and a laser pulse repetition rate of 10 Hz was employed, i.e. 18,000 shots for the entire acquisition with an average of <30 amol per laser shot analyte consumption. Random sampling of individual scans throughout the acquisition shows that each scan (1 sec; 10 laser shots) has a sufficient analyte signal-to-noise ratio for unambiguous detection of the multiply charged ions.

Figure 5A:
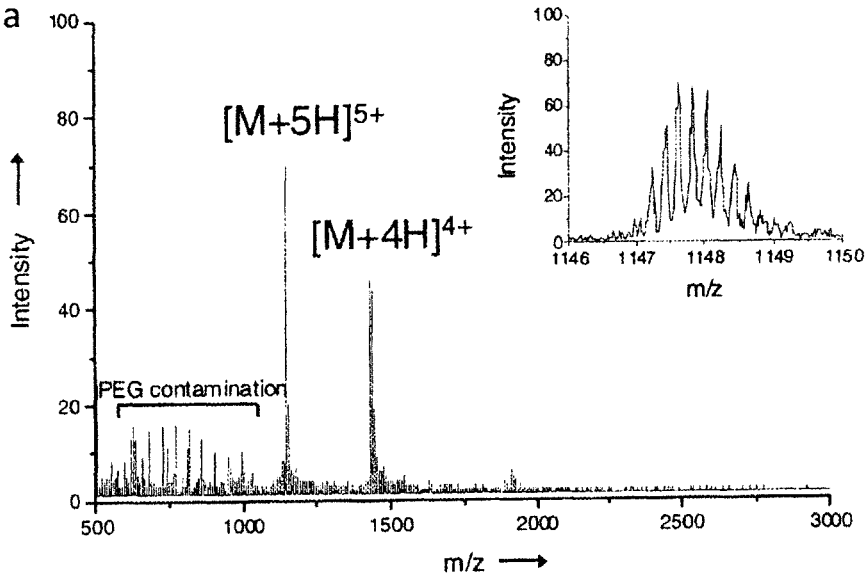
FIG. 5*a*) is an atmospheric pressure UV-MALDI mass spectrum of 5 pmol porcine insulin. The matrix composition was the DHB-based liquid matrix containing ~15% glycerol before volatile solvent evaporation.
Figure 5B:
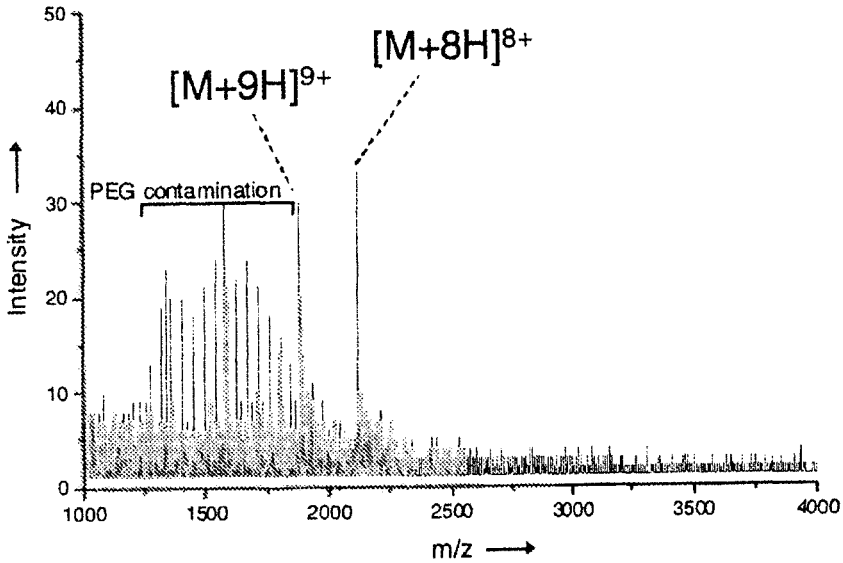
FIG. 5*b*) is an atmospheric pressure UV-MALDI mass spectrum of 5 pmol horse heart myoglobin. The matrix composition was the CHCA-based 1-1-10 liquid matrix containing –30% glycerol before volatile solvent evaporation. The pH value was above 7 as determined by a pH paper test strip. The detected $[M+8M]^{8+}$ and $[M+9H]^{9+}$ analyte ions can be attributed to the apo-form of myoglobin. In both spectra 5*a*) and 5*b*), various polyethylene glycol contaminant ions are also visible (possibly due to adverse storage conditions of the two samples over two years as fully diluted analyte solutions in plastic tubes).
Figure 9:
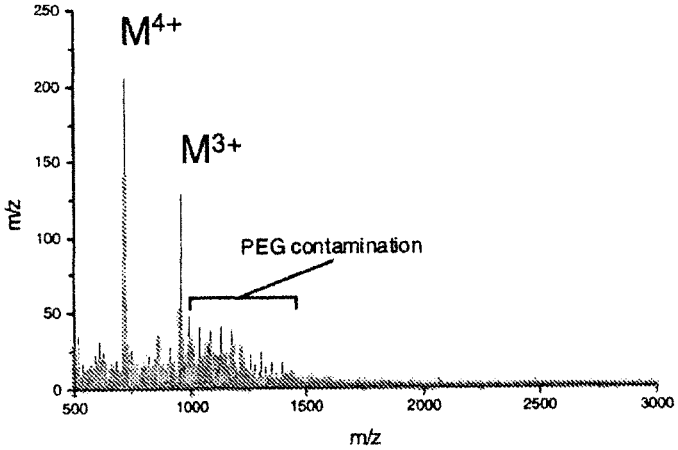
FIG. 9 is an atmospheric pressure UV-MALDI mass spectrum of 50 fmol melittin. The matrix composition was the DHB-based liquid matrix containing ~20% glycerol before volatile solvent evaporation.

As low as 50 fmol of melittin, prepared on a target has been detected, see FIG. 9. Other analytes tested were insulin and myoglobin (see FIG. 5). The observed charge state distributions from these three analytes appear to be very narrow. Thus, the generation of specific charge states and their distributions due to the choice of matrix composition seems to be flexible and somewhat different compared to ESI.

The invention claimed is:

1. A method for producing multiply charged ions, comprising the steps of;

i) providing a matrix composition comprising a matrix material and a non-volatile component, ii) providing an analyte, iii) depositing the matrix composition and the analyte on a surface such that they are in intimate contact, iv) ablating the matrix composition and the analyte deposited on the surface with a laser to desorb multiply charged ions of analyte, and v) passing the desorbed multiply charged ions through a heated conduit, wherein, in step iv), the matrix composition and analyte are ablated in the liquid phase.

2. The method of claim 1 wherein the heated conduit is maintained at a temperature of up to 400° C., and is preferably maintained at between 200° C. and 250° C.

3. The method of claim 1 wherein the heated conduit is a tube.

4. The method of claim 1 wherein the matrix material of the matrix composition of step i) is either DHB or CHCA or a different cinnamic acid derivative.

5. The method of claim 1 wherein the matrix composition further comprises a solvent.

6. The method of claim 5 wherein the solvent comprises a 1:1 mixture of 10-100 mM ammonium phosphate (in water) and methanol.

7. The method of claim 1 wherein the laser is a pulsed laser and has an energy of less than 10 μJ per pulse.

8. The method of claim 1 wherein the laser achieves a maximum fluence of less than 2000 $J/m^2$.

9. The method of claim 1 wherein the laser is a pulsed laser, the energy per pulse is about 1-10 μJ and the fluence is between 200-2000 $J/m^2$.

10. The method of claim 1 wherein the analyte is a peptide, protein or other biomolecule or organic compound.

11. The method of claim 1 wherein the non-volatile component is glycerol, triethylamine or an ionic liquid.

12. The method of claim 11 wherein the glycerol concentration in the matrix composition is between 15% and 85% by volume.

13. The method of claim 1 wherein multiply charged ions exiting the heated conduit are passed into a mass analyzer which preferably comprises an ion trap or quadrupole.

14. The method of claim 13 wherein the analyte concentration in the matrix composition and analyte deposited on the surface is greater than $10^{-12}$ M, the laser is a pulsed laser having a repetition rate of 10 Hz, and data is acquired in the mass analyzer for at least 10 minutes.

15. The method of claim 13 wherein the analyte amount in the matrix composition and analyte deposited on the surface is greater than 1 attomol, the laser is a pulsed laser having a repetition rate of 10 Hz, and data is acquired in the mass analyzer for at least 10 minutes.

16. A method according to claim 1 wherein the laser has a UV or IR wavelength.

* * * * *